US009068570B2

(12) United States Patent
Yamashita et al.

(10) Patent No.: US 9,068,570 B2
(45) Date of Patent: Jun. 30, 2015

(54) MOTOR-DRIVEN COMPRESSOR WITH INTERMITTENT COMMUNICATION BETWEEN BACK PRESSURE REGION AND SUCTION PRESSURE REGION

(71) Applicant: KABUSHIKI KAISHA TOYOTA JIDOSHOKKI, Kariya-shi, Aichi-ken (JP)

(72) Inventors: Takuro Yamashita, Kariya (JP); Ken Suitou, Kariya (JP); Kazuhiro Kuroki, Kariya (JP); Satoru Egawa, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 66 days.

(21) Appl. No.: 13/801,424

(22) Filed: Mar. 13, 2013

(65) Prior Publication Data

US 2013/0259726 A1 Oct. 3, 2013

(30) Foreign Application Priority Data

Mar. 27, 2012 (JP) ..... 2012-072114

(51) Int. Cl.
*F04C 18/02* (2006.01)
*F04C 18/00* (2006.01)

(52) U.S. Cl.
CPC ..... *F04C 18/00* (2013.01); *F04C 18/0215* (2013.01)

(58) Field of Classification Search
CPC ..... F04C 18/0261
USPC ..... 418/55.2, 55.3, 55.5
See application file for complete search history.

(56) References Cited

U.S. PATENT DOCUMENTS

| | | | | | |
|---|---|---|---|---|---|
| 4,596,521 | A | * | 6/1986 | Murayama et al. | 418/55.1 |
| 4,861,245 | A | * | 8/1989 | Tojo et al. | 418/55.3 |
| 4,958,993 | A | * | 9/1990 | Fujio | 418/55.3 |
| 5,263,822 | A | * | 11/1993 | Fujio | 418/55.4 |
| 5,520,526 | A | * | 5/1996 | Fujio | 418/55.4 |
| 5,660,539 | A | * | 8/1997 | Matsunaga et al. | 418/55.6 |
| 5,947,709 | A | * | 9/1999 | Koyama et al. | 418/55.6 |
| 6,174,150 | B1 | * | 1/2001 | Tsubono et al. | 418/55.5 |
| 6,935,852 | B2 | * | 8/2005 | Iida et al. | 418/55.5 |
| 7,101,160 | B2 | * | 9/2006 | Gennami et al. | 418/55.6 |
| 7,264,453 | B2 | * | 9/2007 | Gennami et al. | 418/55.6 |

(Continued)

FOREIGN PATENT DOCUMENTS

| | | | |
|---|---|---|---|
| JP | 61178589 | A * | 8/1986 |
| JP | 04365983 | A | 12/1992 |

(Continued)

OTHER PUBLICATIONS

Machine Translation of JPH 06264876, Jul. 10, 2014, 17 pages.*

*Primary Examiner* — Thomas Denion
*Assistant Examiner* — Xiaoting Hu
(74) *Attorney, Agent, or Firm* — Sughrue Mion, PLLC

(57) ABSTRACT

A motor-driven compressor includes a back pressure region that pushes a movable scroll against a fixed scroll. The back pressure region is located at a side of the movable scroll located proximate to an opposing member. A defining portion, which is arranged on a movable end face, contact an opposing end face to define the back pressure region and a suction pressure region. The opposing member includes a communicating portion. An orbiting motion of the movable scroll moves the defining portion. This intermittently communicates the communicating portion with the back pressure region and the suction pressure region.

5 Claims, 5 Drawing Sheets

(56) References Cited

U.S. PATENT DOCUMENTS

| | | | | |
|---|---|---|---|---|
| 2004/0136855 | A1* | 7/2004 | Kimura et al. | 418/55.5 |
| 2006/0263227 | A1* | 11/2006 | Gennami et al. | 418/55.6 |
| 2008/0008613 | A1* | 1/2008 | Kim et al. | 418/55.6 |
| 2011/0243777 | A1* | 10/2011 | Ito et al. | 418/55.2 |
| 2012/0156068 | A1* | 6/2012 | Shiibayashi et al. | 417/410.5 |
| 2012/0230854 | A1* | 9/2012 | Chikano et al. | 418/55.2 |

FOREIGN PATENT DOCUMENTS

| | | | | |
|---|---|---|---|---|
| JP | 06264876 | A | * | 9/1994 |
| JP | 09228968 | A | | 9/1997 |
| JP | 11022665 | A | | 1/1999 |
| JP | 2002310076 | A | * | 10/2002 |

* cited by examiner

MOTOR-DRIVEN COMPRESSOR WITH INTERMITTENT COMMUNICATION BETWEEN BACK PRESSURE REGION AND SUCTION PRESSURE REGION

BACKGROUND OF THE INVENTION

The present disclosure relates to a motor-driven compressor in which a movable scroll is driven by an electric motor.

Japanese Laid-Open Patent Publication No. 2010-14108 describes an example of a motor-driven compressor that drives a movable scroll of a scroll type compressor with an electric motor. As shown in FIG. 7, a motor-driven compressor 70 (motor-driven scroll type compressor) of the above document includes a front housing 71 that accommodates a rotation shaft 72. FIG. 7 shows the motor-driven compressor 70 with its front end located at the right side and its rear end located at the left side. The rotation shaft 72 includes a front end, which is supported by a bearing 73*a*, and a rear end, which is supported by a bearing 73*b*. This allows the rotation shaft 72 to rotate. A shaft support 74 is arranged in the front housing 71. The compressor 70 includes a fixed scroll 75 and a movable scroll 76. The fixed scroll 75, the movable scroll 76, the shaft support 74, and the rotation shaft 72 are arranged in the compressor 70 from the rear toward the front in this order. A spiral wall 75*a* is formed in the fixed scroll 75, and a spiral wall 76*a* is formed in the movable scroll 76. The engagement of the spiral walls 75*a* and 76*a* forms a compression chamber 77 between the spiral walls 75*a* and 76*a*.

A back pressure chamber 78, which is a back pressure region accommodating a rear end of the rotation shaft 72, is formed between the movable scroll 76 and the shaft support 74. A suction pressure region 79 is formed at the front of the shaft support 74 in the front housing 71. A discharge chamber 81 is formed between the fixed scroll 75 and a rear housing 80. The compression chamber 77 and the discharge chamber 81 are in communication with each other through a discharge port 82. An oil separation chamber 83 is formed in the rear housing 80. An oil separator 84, which separates lubrication oil from a refrigerant gas, is arranged in the oil separation chamber 83. The oil separation chamber 83 and the back pressure chamber 78 are in communication with each other through an oil supplying passage 85. The lubrication oil collected under a discharge pressure in the oil separation chamber 83 is supplied to the back pressure chamber 78 through the oil supplying passage 85.

An oil supplying bore 86 is formed in the rotation shaft 72. The lubrication oil in the back pressure chamber 78 is drawn through the oil supplying bore 86 into the suction pressure region 79, the pressure of which is lower than that of the back pressure chamber 78. The oil supplying bore 86 includes a first opening 86*a*, which opens toward the bearing 73*a* at the front end of the rotation shaft 72, a second opening 86*b*, which opens in the back pressure chamber 78 at the rear end of the rotation shaft 72, and a communication hole 86*c*, which communicates the first opening 86*a* and the second opening 86*b*.

The refrigerant gas discharged into the discharge chamber 81 is drawn into the oil separation chamber 83 where the oil separator 84 separates lubrication oil from the refrigerant gas. The lubrication oil falls from the oil separator 84 and collects in the oil separation chamber 83. The lubrication oil collected in the oil separation chamber 83 is supplied to the back pressure chamber 78 through the oil supplying passage 85. The pressure of the lubrication oil supplied to the back pressure chamber 78 pushes the movable scroll 76 against the fixed scroll 75 and hermetically seals the compression chamber 77. The lubrication oil supplied to the back pressure chamber 78 also enters the oil supplying bore 86 through the second opening 86*b* and is drawn into the suction pressure region 79, the pressure of which is lower than the back pressure chamber 78. Here, the lubrication oil passes through the communication hole 86*c* and the first opening 86*a*, lubricates the bearing 73*a*, and returns to the suction pressure region 79.

However, in the motor-driven compressor 70 of Japanese Laid-Open Patent Publication No. 2010-14108, the lubrication oil supplied to the back pressure chamber 78 and entering the oil supplying bore 86 through the second opening 86*b* is always drawn to the suction pressure region 79. In other words, the back pressure chamber 78 and the suction pressure region 79 are always in communication with each other. This lowers the pressure of the back pressure chamber 78. As a result, the force pushing the movable scroll 76 against the fixed scroll 75 may become insufficient.

SUMMARY

It is an object of the present disclosure to provide a motor-driven compressor that obtains sufficient force for pushing the movable scroll against the fixed scroll.

One aspect of the present disclosure is a motor-driven compressor provided with a compression mechanism unit including a movable scroll and a fixed scroll operative to compress a refrigerant discharged from a suction pressure region. The movable scroll and the fixed scroll define a compression chamber having a volume that is decreased by an orbiting motion of the movable scroll. The compressor also includes a rotation shaft. An electric motor drives the movable scroll with the rotation shaft. A housing accommodates the compression mechanism unit and the electric motor. An opposing member, which is arranged in the housing and opposed to the movable scroll, is located at a side of the movable scroll opposite to the fixed scroll. The opposing member includes an opposing end face, which is opposed to the movable scroll, and the movable scroll includes a movable end face, which is opposed to the opposing member. A back pressure region is located at a side of the movable scroll proximate to the opposing member. A pressure of the refrigerant in the back pressure region is operative to apply a force to the movable scroll, and the force is operative to push the movable scroll against the fixed scroll. A defining portion, which is arranged in the movable end face, contacts the opposing end face and defines the back pressure region and the suction pressure region. The orbiting motion of the movable scroll moves the defining portion. The opposing member includes a communicating portion. When the orbiting motion of the movable scroll moves the defining portion, the communicating portion intermittently communicates the back pressure region and the suction pressure region.

In this aspect, as the orbiting motion of the movable scroll moves the defining portion, the pressure of the back pressure region decreases only when the back pressure region and the suction pressure region are in communication with each other through the communicating portion. The pressure of the back pressure region does not decrease when the back pressure region and the suction pressure region are not in communication with each other through the communicating portion. Thus, in contrast to when the back pressure region and the suction pressure region are in constant communication, this aspect ensures that the force for pushing the movable scroll against the fixed scroll is obtained.

In one aspect, in the motor-driven compressor, the back pressure region and the suction pressure region are configured to be out of communication with each other when the communicating portion is located at a radially inner side of the defining portion. Further, the back pressure region and the suction pressure region are configured to be in communication with each other when at least part of the communicating portion is located at a radially outer side of the defining portion.

In this aspect, as the orbiting motion of the movable scroll moves the defining portion, the back pressure region and the suction pressure region come into communication with each other through the communicating portion and decreases the pressure of the back pressure region only when at least part of the communicating portion is located at the radially outer side of the defining portion. When the communicating portion is located at the radially inner side of the defining portion, the back pressure region and the suction pressure region do not come into communication with each other. Thus, the pressure of the back pressure region does not lower. In this manner, the orbiting motion of the movable scroll automatically and intermittently communicates the back pressure region and the suction pressure region with each other. This easily obtains the force for pushing the movable scroll against the fixed scroll.

In one aspect, the motor-driven compressor further includes a motor compartment that accommodates the electric motor in the housing. The motor compartment forms the suction pressure region. An accommodation compartment accommodates the compression mechanism unit. A shaft support, which is arranged in the housing, defines the motor compartment and the accommodation compartment. The opposing member includes a plate arranged between the compression mechanism unit and the shaft support to seal the back pressure region and the suction pressure region. A communication hole, which serves as the communicating portion, is formed in the plate.

In this aspect, the back pressure region and the suction pressure region come into intermittent communication with each other just by forming the communication hole in the plate.

In one aspect, in the motor-driven compressor, the shaft support includes a shaft supporting end face opposed to the plate. The shaft supporting end face includes a recess that opens to the communication hole.

In contrast with when the recess is not formed in the end face of the shaft support opposed to the plate, this aspect smoothes the communication between the back pressure region and the suction pressure region, and the pressure of the back pressure region is easily decreased. This suppresses excessive pushing of the movable scroll against the fixed scroll. Further, the pressure of the back pressure region can be adjusted by changing the dimensions of the recess, that is, the recessing amount.

In one aspect, in the motor-driven compressor, the housing includes a motor compartment that accommodates the electric motor and forms the suction pressure region. The back pressure region and a bearing accommodation chamber are formed between the movable scroll and the opposing member. The bearing accommodation chamber accommodates a bearing that supports the rotation shaft proximal to the compression mechanism unit. The back pressure region and the bearing accommodation chamber are disconnected by a barrier. The rotation shaft includes a shaft passage. The shaft passage includes an outlet that opens to the motor compartment. The motor-driven compressor further includes a discharge pressure region, a first oil passage that communicates the compression chamber with the back pressure region, and a second oil passage that communicates the bearing accommodation chamber with the discharge pressure region. The shaft passage is in communication with the first oil passage or the second oil passage.

In this aspect, the lubrication oil supplied to the back pressure region through the first oil passage and the lubrication oil supplied to the accommodation chamber through the second oil passage are used differently. This ensures lubrication of the bearings Other aspects and advantages of the disclosure will become apparent from the following description, taken in conjunction with the accompanying drawings, illustrating by way of example the principles of the disclosure.

BRIEF DESCRIPTION OF THE DRAWINGS

The features of the present disclosure that are believed to be novel are set forth with particularity in the appended claims. The disclosure, together with objects and advantages thereof, may best be understood by reference to the following description of the presently preferred embodiments together with the accompanying drawings in which:

DETAILED DESCRIPTION OF THE PREFERRED EMBODIMENTS

A scroll type motor-driven compressor according to a first embodiment of the present disclosure will now be described with reference to FIGS. 1 to 5. The compressor is mounted on a vehicle and used in a vehicle air conditioner.

Figure 1:
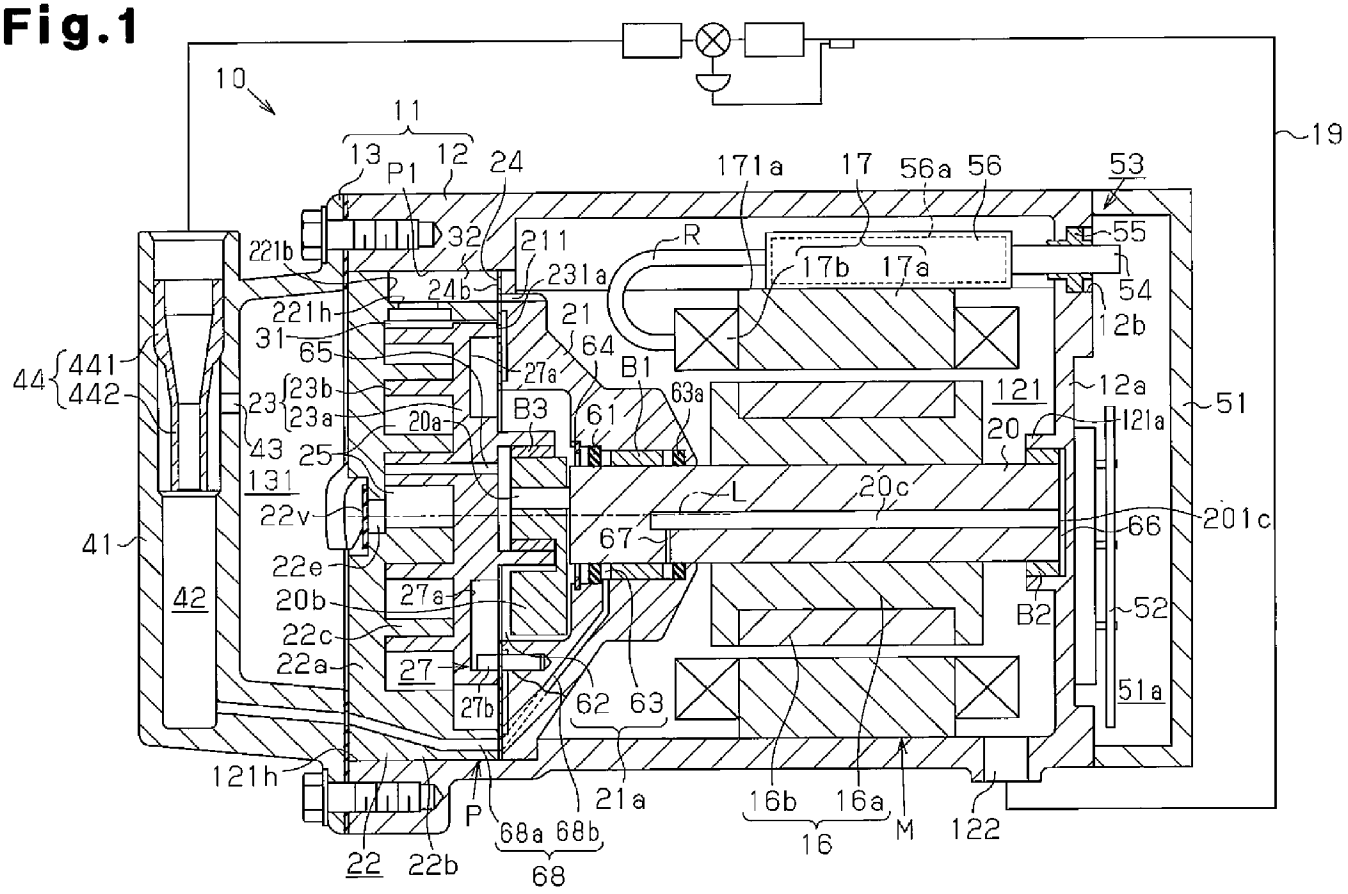
FIG. 1 is a cross-sectional side view showing of a motor-driven compressor according to a first embodiment.

As shown in FIG. 1, a motor-driven compressor 10 includes a housing 11 made of a metal material, which is aluminum in the first embodiment. The housing 11 includes a motor housing 12 and a discharge housing 13. The motor housing 12 is cylindrical and has an open end 121*h* (left end in FIG. 1) and a closed end. The discharge housing 13 is cylindrical and has one end coupled to the open end 121*h* of the motor housing 12 and another closed end. The motor housing 12 accommodates a compression mechanism unit P, which compresses a refrigerant, and an electric motor M, which is a drive source for the compression mechanism unit P.

The closed end of the motor housing 12 defines an end wall 12*a*. A cylindrical shaft support 121*a* projects from a central part of the end wall 12*a*. Another shaft support 21 is fixed to the motor housing 12 near the open end 121*h*. An insertion hole 21*a* extends through the central part of the shaft support 21. The shaft support 21 divides the interior of the motor housing 12 into a motor compartment 121, which accommodates the electric motor M, and an accommodation compartment P1, which accommodates the compression mechanism unit P. The rotation shaft 20 is accommodated in the motor housing 12. The rotation shaft 20 includes a first end, which is proximal to the open end 121*h*, and a second end, which is proximal to the end wall 12*a* of the motor housing 12. The first end of the rotation shaft 20 is located in the insertion hole 21*a* of the shaft support 21 and is rotatably supported by a bearing B1 on the shaft support 21. The second end of the rotation shaft 20 is rotatably supported by a bearing B2 on the shaft support 121*a*. The bearings B1 and B2 are slide bearings.

The motor compartment 121 in the motor housing 12 is formed at the side of the shaft support 21, opposed to the end wall 12*a*, or closed end of the motor housing 12. The electric motor M in the motor compartment 121 includes a rotor 16, which rotates integrally with the rotation shaft 20, and a stator 17, which is fixed to an inner circumferential surface of the motor housing 12 surrounding the rotor 16. The rotor 16 includes a rotor core 16*a* and a plurality of permanent magnets 16*b* arranged in the circumferential surface of the rotor core 16*a*. The rotor core 16*a* is fixed to the rotation shaft 20 to rotate integrally with the rotation shaft 20. The stator 17 includes an annular stator core 17*a*, which is fixed to the inner circumferential surface of the motor housing 12, and coils 17*b*, which are wound around teeth (not shown) of the stator core 17*a*. Each coil 17*b* includes a first coil end, which is proximal to the shaft support 21, and a second coil end, which is proximal to the end wall 12*a* of the motor housing 12. Lead wires R for a U phase, V phase, and W phase extend from the first coil end. Only one lead wire R is shown in FIG. 1 to facilitate illustration.

The accommodation compartment P1 in the motor housing 12 is formed at the side of the shaft support 21 opposed to the open end 121*h*. A fixed scroll 22 is arranged in the accommodation compartment P1. The fixed scroll 22 includes a circular base plate 22*a*, a cylindrical outer wall 22*b*, and a fixed spiral wall 22*c*. The fixed spiral wall 22*c* projects from the base plate 22*a* and is arranged at a radially inner side of the outer wall 22*b*. A plate 24, which is annular and flat, is arranged between the fixed scroll 22 and the shaft support 21. The plate 24 is formed from an elastic body of a metal material, such as a carbon tool steel. The plate 24 is elastically deformable and has spring property. The plate 24 seals the gap between the fixed scroll 22 and the shaft support 21. The fixed scroll 22, which is opposed to the shaft support 21 and the plate 24, is fitted into and fixed to the motor housing 12.

An eccentric shaft 20*a* projects from an end face of the first end of the rotation shaft 20 proximal to the open end 121*h*. The eccentric shaft 20*a* is eccentric relative to a rotation axis L of the rotation shaft 20. A bushing 20*b* is externally fitted and fixed to the eccentric shaft 20*a*. The movable scroll 23 is supported by a bearing B3 on the bushing 20*b* to be rotatable relative to the bushing 20*b*. The movable scroll 23 includes a circular base plate 23*a* and a movable spiral wall 23*b*, which projects toward the base plate 22*a* of the fixed scroll 22.

The movable scroll 23 is accommodated in an orbital manner between the shaft support 21 and the plate 24 and the fixed scroll 22 so that an orbital motion of the movable scroll 23 is possible. The fixed spiral wall 22*c* of the fixed scroll 22 and the movable spiral wall 23*b* of the movable scroll 23 are engaged with each other. A distal end face of the fixed spiral wall 22*c* is in contact with the base plate 23*a* of the movable scroll 23. A distal end face of the movable spiral wall 23*b* is in contact with the base plate 22*a* of the fixed scroll 22. The base plate 22*a* and fixed spiral wall 22*c* of the fixed scroll 22 form a compression chamber 25 with the base plate 23*a* and movable spiral wall 23*b* of the movable scroll 23.

The base plate 23*a* of the movable scroll 23 has a movable end face 231*a* located at the opposite side of the fixed scroll 22. The movable end face 231*a* is opposed to an opposing end face 24*b* of the plate 24. In the first embodiment, the plate 24, which forms an opposing member opposed to the movable scroll 23, is arranged in the housing 11 on the movable end face 231*a* of the movable scroll 23 at the opposite side of the fixed scroll 22. The opposing end face 24*b* of the plate 24 is opposed to the movable end face 231*a* of the movable scroll 23. The plate 24 is accommodated in the motor housing 12 between the compression mechanism unit P and the electric motor M.

Figure 2:
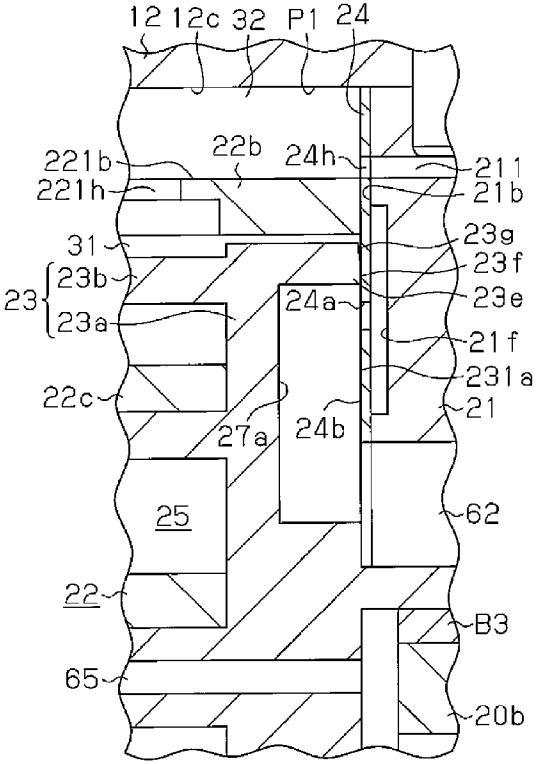
FIG. 2 is an enlarged cross-sectional side view showing a projection of a movable scroll of FIG. 1.

As shown in FIG. 2, an annular projection 23*e* is formed on the outer circumference of the movable end face 231*a* of the base plate 23*a* in the movable scroll 23. The projection 23*e* includes a distal end face formed so that its inner circumferential edge 23*f* is slightly higher than its outer circumferential edge 23*g*. In other words, the inner circumferential edge 23*f* has a slightly larger axial projection amount than the outer circumferential edge 23*g*. The distal end face of the projection 23*e* is pushed against the plate 24.

As shown in FIG. 1, a rotation prohibition mechanism 27 is arranged between the base plate 23*a* of the movable scroll 23 and the shaft support 21. The rotation prohibition mechanism 27 includes a plurality of annular holes 27*a* and a plurality of pins 27*b*. The annular holes 27*a* are arranged in a circumferential portion of the movable end face 231*a* of the base plate 23*a* in the movable scroll 23. The pins 27*b* project from a circumferential portion of the shaft support 21 and are loosely fitted into the annular holes 27*a*. In FIG. 1, only one pin 27*b* is shown to facilitate illustration.

When the electric motor M rotates and drives the rotation shaft 20, due to the eccentric shaft 20*a*, the movable scroll 23 orbits around the axis of the fixed scroll 22, that is, around the rotation axis L of the rotation shaft 20. In this state, the rotation prohibition mechanism 27 prohibits rotation of the movable scroll 23. This permits only the orbiting motion of the movable scroll 23. The orbiting motion of the movable scroll 23 reduces the volume of the compression chamber 25. In this manner, the fixed scroll 22 and the movable scroll 23 form the compression mechanism unit P that draws in and discharges the refrigerant.

As shown in FIG. 2, a suction chamber 31, which is in communication with the compression chamber 25, is defined between the outer wall 22*b* of the fixed scroll 22 and the outermost portion of the movable spiral wall 23*b* of the movable scroll 23. A recess 221*b* is formed in an outer circumferential surface of the outer wall 22*b* of the fixed scroll 22. A through hole 221*h* extends through the outer wall 22*b* of the fixed scroll 22. A suction passage 32, which is connected to the suction chamber 31 through the through hole 221*h*, is formed in a region surrounded by the surface of the outer wall 22*b*, which defines the recess 221*b*, and the inner circumferential surface 12*c* of the motor housing 12. A through hole 211 extends through the circumferential portion of the shaft support 21. A through hole 24*h* extends through the circumferential portion of the plate 24. The motor compartment 121 is connected to the suction passage 32 through the through hole 211 and the through hole 24*h*.

As shown in FIG. 1, the motor housing 12 includes a suction port 122. The suction port 122 is connected to an external refrigerant circuit 19. Refrigerant (gas) is drawn into the motor compartment 121 from the external refrigerant circuit 19 through the suction port 122. The refrigerant drawn into the motor compartment 121 is further drawn into the compression chamber 25 through the through hole 211, the through hole 24*h*, the suction passage 32, the through hole 221*h*, and the suction chamber 31. Accordingly, the motor compartment 121, the through hole 211, the through hole 24*h*, the suction passage 32, the through hole 221*h*, and the suction chamber 31 form a suction pressure region. The compression mechanism unit P compresses a refrigerant discharged from the suction pressure region.

The refrigerant in the compression chamber 25 is compressed by the orbiting motion of the movable scroll 23. The compressed refrigerant pushes a discharge valve 22*v* away from a discharge port 22*e*. As a result, the compressed refrigerant is discharged into the discharge chamber 131 of the discharge housing 13.

A chamber formation wall 41 is formed integrally with the discharge housing 13. An oil separation chamber 42 is formed between the discharge housing 13 and the chamber formation wall 41. The oil separation chamber 42 is in communication with the discharge chamber 131 through a discharge port 43 formed in the discharge housing 13. The refrigerant in the discharge chamber 131 flows through the discharge port 43 into the oil separation chamber 42.

The oil separation chamber 42 is coupled to an oil separation tube 44. The oil separation tube 44 includes a large diameter portion 441, which is distant from the oil separation chamber 42, and a small diameter portion 442, which is located proximate to the oil separation chamber 42 than the large diameter portion 441. The large diameter portion 441 is fitted to the oil separation chamber 42. The small diameter portion 442 has a smaller diameter than the oil separation chamber 42. The refrigerant that flows out of the discharge port 43 into the oil separation chamber 42 is swirled around the small diameter portion 442 before entering the oil separation tube 44 through a lower opening of the small diameter portion 442. The refrigerant then flows out of the oil separation tube 44 and enters the external refrigerant circuit 19, which returns the refrigerant to the motor compartment 121. Lubrication oil is separated from the refrigerant when the refrigerant swirls around the small diameter portion 442. The lubrication oil separated from the refrigerant fall into the lower part of the oil separation chamber 42. Accordingly, the discharge port 22*e*, the discharge chamber 131, the discharge port 43, and the oil separation chamber 42 form a discharge pressure region.

An inverter cover 51, which is made of a metal material, is fixed to the end wall 12*a* of the motor housing 12. The inverter cover 51 is made of aluminum in the first embodiment. A motor drive circuit 52 is fixed to the outer surface of the end wall 12*a* in a void formed between the end wall 12*a* of the motor housing 12 and the inverter cover 51. Accordingly, in the first embodiment, the compression mechanism unit P, the electric motor M, and the motor drive circuit 52 are arranged in this order along the direction of the rotation axis L of the rotation shaft 20.

The through hole 12*b* is formed in the end wall 12*a* of the motor housing 12. A sealing terminal 53 is arranged in the through hole 12*b* to electrically connect the electric motor M and the motor drive circuit 52. Three metal terminals 54, which extend through the motor housing 12, and three glass insulators 55, which fixing the metal terminals 54 to the end wall 12*a*, are arranged on the sealing terminal 53. Only one metal terminal 54 and one metal terminal 54 are shown in FIG. 1 to facilitate illustration. The insulators 55 insulate the metal terminal 54 from the end wall 12*a*. A first end of each metal terminal 54 is electrically connected to the motor drive circuit 52 by a cable (not shown). A second end of the metal terminal 54 extends into the motor housing 12.

A cluster block 56, which is made of an insulative resin, is fixed to an outer circumferential surface 171*a* of the stator core 17*a*. Three connecting terminals 56*a* are accommodated in the cluster block 56. In FIG. 1, only one connecting terminal 56*a* is shown to facilitate illustration. The lead wires R are electrically connected to the metal terminals 54 through the connecting terminals 56*a*. Power is supplied from the motor drive circuit 52 to the coils 17*b* through the metal terminals 54, the connecting terminal 56*a*, and the lead wire R. This integrally rotates the rotor 16 and the rotation shaft 20.

A ring-shaped seal 61, which contacts the circumferential surface of the rotation shaft 20 in a slidable manner, divides the insertion hole 21*a* of the shaft support 21 into a back pressure chamber 62 and a bearing accommodation chamber 63, which accommodates the bearing B1. The back pressure chamber 62 is located at the side of the seal 61 that is proximate to the movable scroll 23. The bearing accommodation chamber 63 is located at the side of the bearing B1 that is proximate to the seal 61. Accordingly, in the first embodiment, the seal 61 functions as a barrier that partitions and disconnects the back pressure chamber 62 and the bearing accommodation chamber 63. A circlip 64 is arranged in the insertion hole 21*a* of the shaft support 21 at a portion proximal to the back pressure chamber 62. The circlip 64 prevents separation of the seal 61 from the rotation shaft 20 toward the back pressure chamber 62.

As shown in FIG. 2, the back pressure chamber 62 is in communication with the annular hole 27*a* through the radially inner side of the plate 24. A communication hole 24*a*, which serves as a communicating portion, is formed in the plate 24. The communication hole 24*a*, which is a circular hole, is formed in a range in which the projection 23*e* moves, during the orbiting motion of the movable scroll 23, as indicated by a thick line in FIG. 3, that is, a region Z indicated by diagonal lines in FIG. 3.

As shown in FIG. 2, an annular recess 21*f*, which surrounds the back pressure chamber 62, is formed in a shaft supporting end face 21*b* of the shaft support 21, which is opposed to the plate 24. The recess 21*f* is formed over a region wider than the region Z of the moving range of the projection 23*e*. The recess 21*f* functions as a void that allows the plate 24 to elastically deform toward the shaft support 21. The communication hole 24*a* is open toward the recess 21*f*.

As shown in FIG. 1, a first oil passage 65 extends through a center portion of the movable spiral wall 23*b* and the central portion of the base plate 23*a*. The first oil passage 65 includes a first end that opens in the compression chamber 25 and a second end that opens in the back pressure chamber 62. Some of the refrigerant compressed in the compression chamber 25 is supplied to the back pressure chamber 62 through the first oil passage 65. The refrigerant supplied to the back pressure chamber 62 flows into the annular hole 27*a* at the radially inner side of the plate 24. The pressure of the refrigerant supplied to the back pressure chamber 62 and the annular hole 27*a* pushes the movable scroll 23 against the fixed scroll 22.

The projection 23*e* divides the interior of the motor housing 12 into a portion located at the radially outer side of the projection 23*e*, which defines a suction pressure region including the suction chamber 31, and a portion located at the radially inner side of the projection 23*e*, which defines a back pressure region including the annular hole 27*a* and the back pressure chamber 62. The pressure of the refrigerant in the back pressure region applies force to the movable scroll 23 that pushes the movable scroll 23 against the fixed scroll 22. In this manner, the contact of the projection 23*e* with the plate 24 forms a defining portion that functions to define the back pressure region and the suction pressure region.

A shaft passage 20*c* extends through the rotation shaft 20. The shaft passage 20*c* includes an outlet 201*c* formed in the end face of the second end proximal of the rotation shaft 20 to the end wall 12*a* of the motor housing 12. A gap 66 is formed between the end wall 12*a* and the end face of the rotation shaft 20 proximal to the end wall 12*a* of the motor housing 12. The bearing accommodation chamber 63 is in communication with the shaft passage 20*c* through a passage 67 extending in the radial direction of the rotation shaft 20. The passage 67, which opens to the bearing accommodation chamber 63, serves as an inlet to the shaft passage 20*c* from the bearing accommodation chamber 63. A seal 63*a* is arranged in the bearing accommodation chamber 63 at the side of the bearing B1 proximate to the motor compartment 121. The seal 63*a* prevents leakage of the refrigerant along the circumferential surface of the rotation shaft 20 from the bearing accommodation chamber 63 to the motor compartment 121.

The shaft passage 20*c* is in communication with a second oil passage 68 through the passage 67 and the bearing accommodation chamber 63. The bearing accommodation chamber 63 is in communication with the oil separation chamber 42 through the second oil passage 68. The second oil passage 68 is formed by a passage 68*a* and a passage 68*b*, which is in communication with the passage 68*a*. The passage 68*a* passes through the discharge housing 13 and the fixed scroll 22 from the portion of the oil separation chamber 42 opposite to the oil separation tube 44. The passage 68*b* extends through the shaft support 21 to the bearing accommodation chamber 63.

The operation of the first embodiment will now be described.

Figure 3:
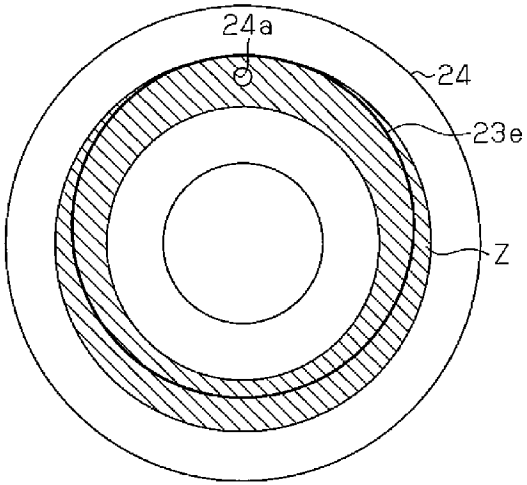
FIG. 3 is a schematic view showing the location of the projection in the movable scroll of FIG. 2.
Figure 5:
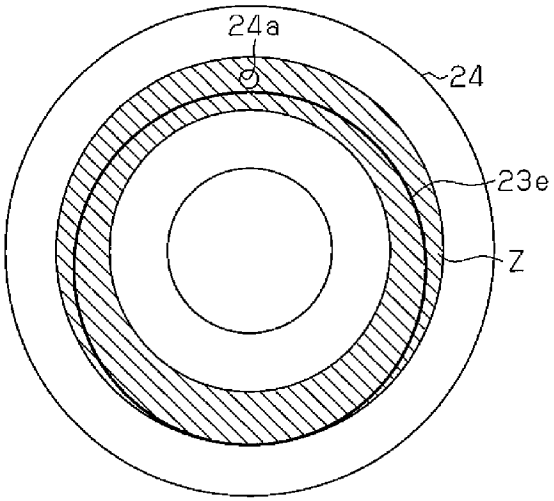
FIG. 5 is a schematic view showing the location of the projection in the movable scroll of FIG. 4.
Figure 4:
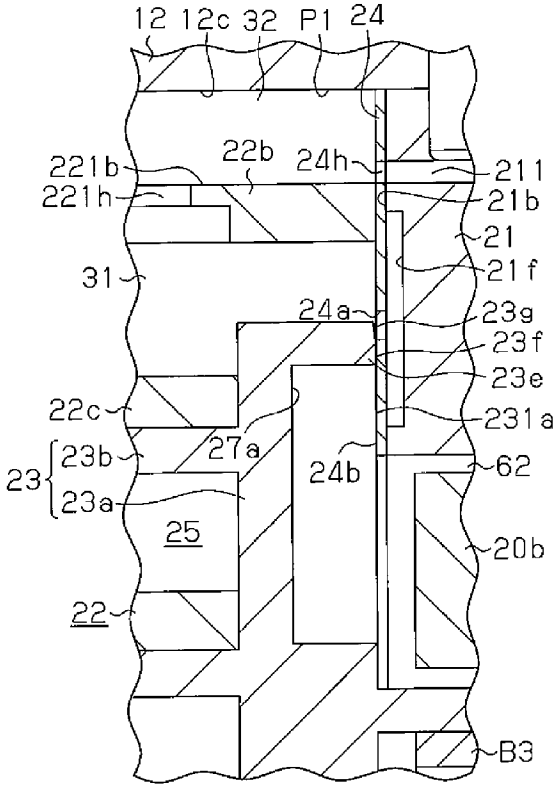
FIG. 4 is an enlarged cross-sectional side view showing the projection in a state in which the movable scroll is moved from the state of FIG. 2.

Referring to FIGS. 2 and 3, during the orbiting motion of the movable scroll 23, when the communication hole 24*a* is located inward in the radial direction of the motor housing 12 from the projection 23*e*, that is, when the communication hole 24*a* is opposed to the annular hole 27*a*, the annular hole 27*a* and the recess 21*f* are in communication with each other through the communication hole 24*a*. Thus, the refrigerant supplied from the back pressure chamber 62 to the annular hole 27*a* is supplied through the communication hole 24*a* to the recess 21*f*, which serves as the back pressure region. Then, as shown in FIGS. 4 and 5, as the movable scroll 23 orbits and moves the projection 23*e*, when at least part of the communication hole 24*a* is located outward in the radial direction of the motor housing 12 from the projection 23*e*, that is, when at least part of the communication hole 24*a* is opposed to the suction chamber 31, the recess 21*f* and the suction chamber 31 are in communication with each other through the communication hole 24*a*. Thus, the refrigerant supplied to the recess 21*f* returns to the suction chamber 31 through the communication hole 24*a*. In this manner, the movement of the projection 23*e* resulting from the orbiting motion of the movable scroll 23 intermittently communicates the recess 21*f*, which is the back pressure region, and the suction chamber 31, which is the suction pressure region, through the communication hole 24*a*.

When the recess 21*f* and the suction chamber 31 are not in communication with each other through the communication hole 24*a*, the pressure of the back pressure region does not decrease. This obtains the force that pushes the movable scroll 23 against the fixed scroll 22. The pressure of the back pressure region decreases only when the orbiting motion of the movable scroll 23 moves the projection 23*e* and thereby communicates the recess 21*f* and the suction chamber 31 with each other through the communication hole 24*a*. Therefore, in contrast with a comparative example in which the back pressure region and the suction pressure region are constantly in communication with each other, the first embodiment obtains sufficient force for pushing the movable scroll 23 against the fixed scroll 22. This improves the compression efficiency of the refrigerant in the compression chamber 25.

As shown in FIG. 1, some of the refrigerant compressed in the compression chamber 25 is supplied to the back pressure chamber 62 through the first oil passage 65. The refrigerant supplied to the back pressure chamber 62 passes by the bearing B3. The bearing B3 is lubricated by the lubrication oil contained in the refrigerant passing by the bearing B3. This results in the bearing B3 allowing for satisfactory relative rotation of the bushing 20*b* and the movable scroll 23.

Some of the refrigerant in the oil separation chamber 42 and the lubrication oil separated in the oil separation chamber 42 flow into the bearing accommodation chamber 63 through the second oil passage 68. The lubrication oil flowing into the bearing accommodation chamber 63 passes by the bearing B1 together with the refrigerant. The lubrication oil passing by the bearing B1 lubricates the bearing B1. The lubrication oil that lubricates the bearing B1 passes by the bearing B2 through the passage 67, the shaft passage 20*c*, and the gap 66 together with the refrigerant. The lubrication oil passing by the bearing B2 lubricates the bearing B2. This results in the bearings B1, B2 allowing for satisfactory rotation of the rotation shaft 20. The lubrication oil that passes by the bearing B2 is returned to the motor compartment 121 together with the refrigerant.

The first embodiment has the following advantages.

(1) When the orbiting motion of the movable scroll 23 moves the projection 23*e*, the communication hole 24*a* which is formed in the plate 24 intermittently communicates the back pressure region and the suction pressure region with each other. Thus, the pressure of the back pressure region decreases only when the back pressure region and the suction pressure region come into communication with each other through the communication hole 24*a* as the orbiting motion of the movable scroll 23 moves the projection 23*e*. When the back pressure region and the suction pressure region are not in communication with each other through the communication hole 24*a*, the pressure of the back pressure region does not decrease. As a result, in contrast with a comparative example in which the back pressure region and the suction pressure region are constantly in communication with each other, the first embodiment obtains force for pushing the movable scroll 23 against the fixed scroll 22.

(2) In the first embodiment, as the movable scroll 23 orbits and moves the projection 23*e*, the back pressure region and the suction pressure region come into communication with each other through the communication hole 24*a* and decreases the pressure of the back pressure region only when at least part of the communication hole 24*a* is located at the radially outer side of the projection 23*e*, that is, when at least part of the communication hole 24*a* is opposed to the suction chamber 31. When the communication hole 24*a* is located at the radially inner side of the projection 23*e*, that is, when the communication hole 24*a* is opposed to the annular hole 27*a*, the back pressure region and the suction pressure region do not come into communication with each other and the pressure of the back pressure region does not decrease. In other words, by using the orbiting motion of the movable scroll 23 to automatically communicate the back pressure region and the suction pressure region with each other intermittently, the force for pushing the movable scroll 23 against the fixed scroll 22 is easily ensured.

(3) In the first embodiment, the back pressure region and the suction pressure region are intermittently communicated with each other just by forming the communication hole 24*a* in the plate 24. The plate 24 has been conventionally used in the motor-driven compressor 10. Therefore, in the first embodiment, a new and additional member does not have to be used to intermittently communicate the back pressure region and the suction pressure region. The back pressure region and the suction pressure region can be intermittently communicated with each other just be machining the plate 24, which has been conventionally used.

(4) The recess 21*f*, in which the communication hole 24*a* opens, is formed in the shaft supporting end face 21*b* of the shaft support 21 that contacts the plate 24. Therefore, compared to when the recess 21*f* is not formed in the shaft supporting end face 21*b* of the shaft support 21 that contacts the plate 24, in the first embodiment, the back pressure region and the suction pressure region come into communication with each other more smoothly, and the pressure of the back pressure region decreases more easily. This suppresses excessive pushing of the movable scroll 23 against the fixed scroll 22. Further, the amount of refrigerant supplied from the annular hole 27*a* to the recess 21*f* through the communication hole 24*a* is adjusted by changing the dimensions of the recess 21*f*. This adjusts the amount of refrigerant returned from the recess 21*f* to the suction chamber 31 through the communication hole 24*a*. Thus, the pressure of the back pressure region can be adjusted.

(5) The seal 61 disconnects the back pressure chamber 62 and the bearing accommodation chamber 63. The first oil passage 65 communicates the compression chamber 25 and the back pressure chamber 62 with each other, and the second oil passage 68 communicates the bearing accommodation chamber 63 and the oil separation chamber 42 with each other. Further, the passage 67 and the bearing accommodation chamber 63 communicate the shaft passage 20*c* and the second oil passage 68. Therefore, the lubrication oil supplied from the compression chamber 25 to the back pressure chamber 62 through the first oil passage 65 lubricates the bearing B3, and the lubrication oil supplied from the oil separation chamber 42 to the bearing accommodation chamber 63 through the second oil passage 68 lubricates the bearings B1, B2. In other words, the lubrication oil supplied to the back pressure chamber 62 through the first oil passage 65 and the lubrication oil supplied to the bearing accommodation chamber 63 through the second oil passage 68 are used differently. This ensures lubrication of the bearings B1, B2, B3.

(6) The seal 61 disconnects the back pressure chamber 62 and the bearing accommodation chamber 63. Thus, in a state in which sealing is ensured between the back pressure chamber 62 and the bearing accommodation chamber 63, the back pressure chamber 62 and the bearing accommodation chamber 63 are disconnected.

(7) In the first embodiment, the refrigerant of the back pressure region is intermittently returned to the suction chamber 31 through the communication hole 24*a*, which prevents the refrigerant from stagnating in the back pressure region. The refrigerant supplied to the back pressure region is returned to the suction pressure region and drawn again to the compression chamber 25 to be compressed in the compression chamber 25. Thus, the refrigerant is efficiently circulated in the motor-driven compressor 10.

The first embodiment may be modified as below.

Figure 6B:
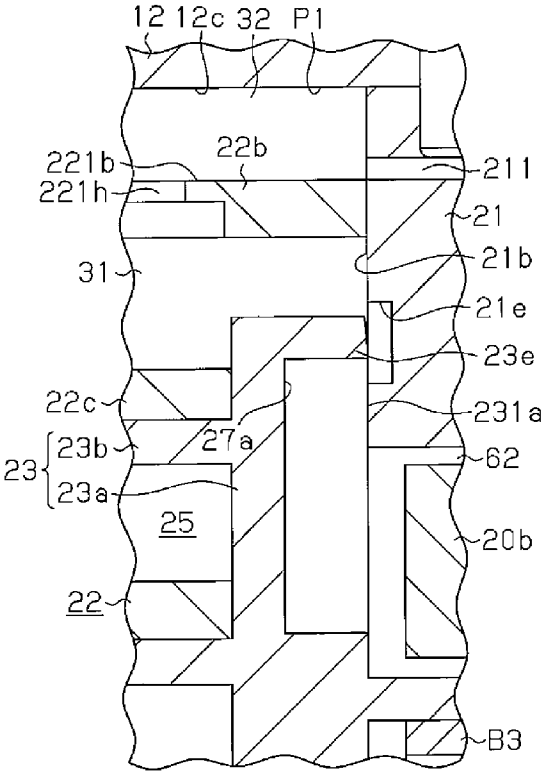
FIG. 6*b* is a cross-sectional side view showing the projection in a state moved from the state of FIG. 6*a*.
Figure 6A:
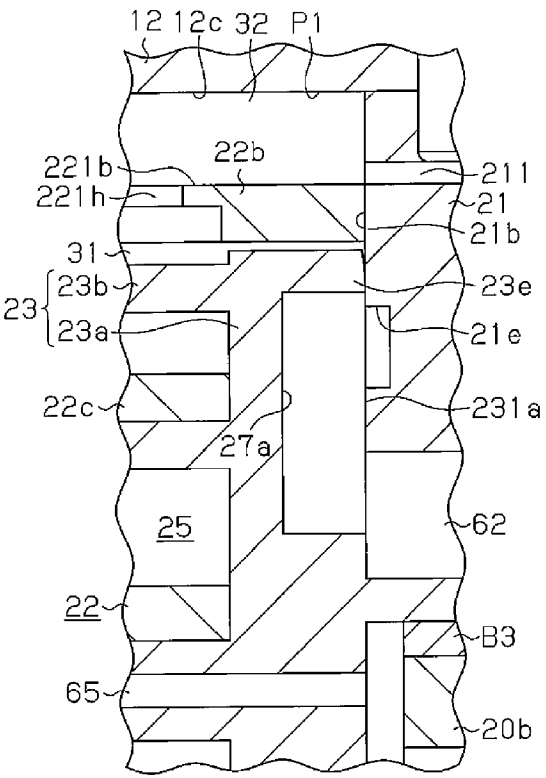
FIG. 6*a* is an enlarged cross-sectional side view showing a projection in another example.
Figure 7:
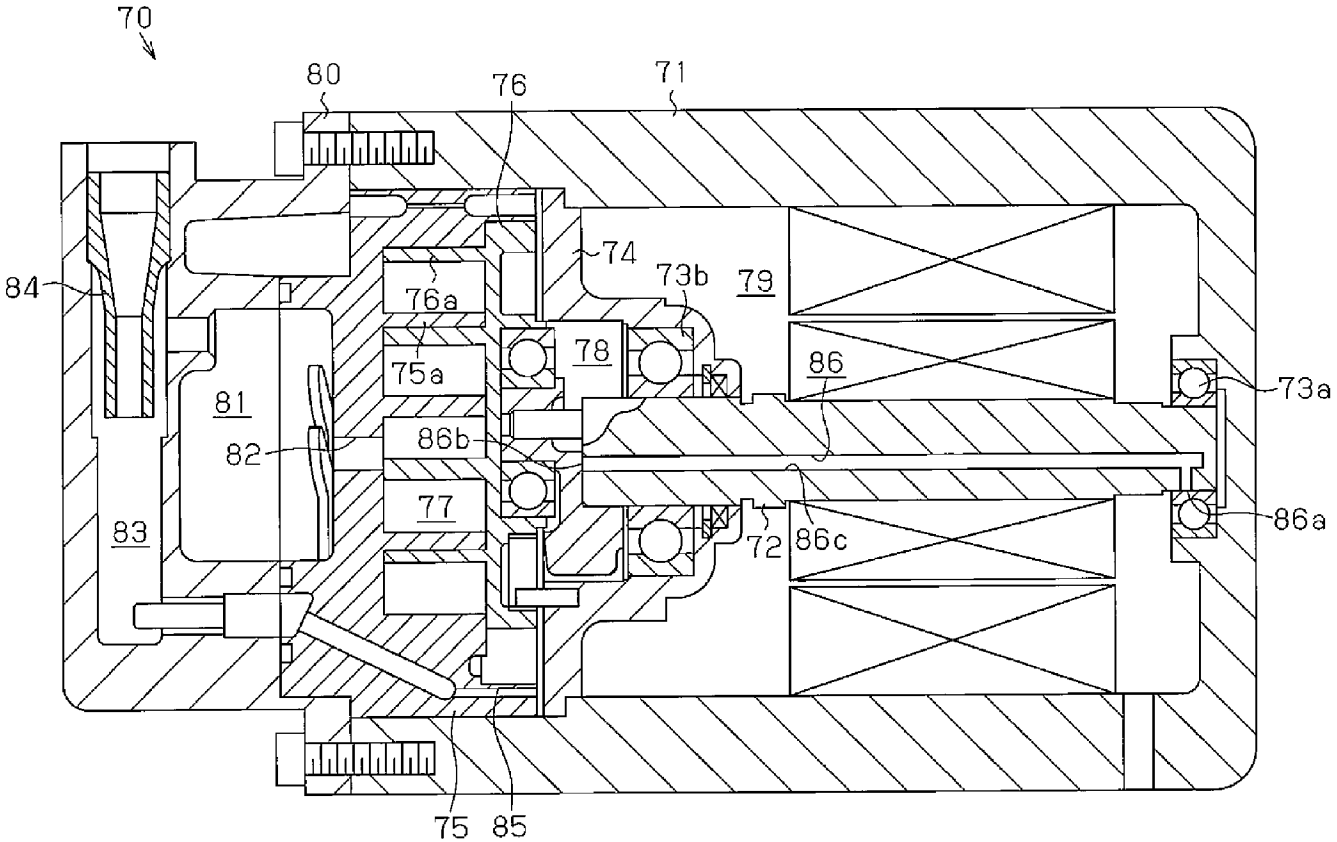
Fig.7 (Prior Art)
FIG. 7 is a cross-sectional side view showing a conventional motor-driven compressor.

As shown in FIGS. 6*a* and 6*b*, in another example, the plate 24 may be omitted, and a communication groove 21*e*, which serves as the communicating portion, may be formed in the shaft supporting end face 21*b*, which serves as the opposing end face of the shaft support 21 opposed to the movable scroll 23. In this case, the shaft support 21, which serves as the opposing member, is located at the side of the movable scroll that is opposite to the fixed scroll 22. Further, the shaft support 21 is opposed to the movable scroll 23 in the housing 11. Part of the communication groove 21*e* is formed in the moving range of the projection 23*e*, and the other parts of the communication groove 21*e* that are not formed in the moving range of the projection 23*e* is formed to extend radially inward out of the moving range of the projection 23*e*. Referring to FIG. 6*a*, when the communication groove 21*e* is located at the radially inner side of the projection 23*e*, that is, when the communication groove 21*e* is opposed to the annular hole 27*a*, the projection 23*e* pushes the shaft supporting end face 21*b* of the shaft support 21 so that the back pressure region and the suction pressure region are defined in a non-communication state. Then, referring to FIG. 6*b*, when the orbiting motion of the movable scroll 23 moves the projection 23*e* and at least part of the communication groove 21*e* becomes located at the radially outer side of the projection 23*e*, that is, when at least part of the communication groove 21*e* is opposed to the suction chamber 31, the annular hole 27*a* and the suction chamber 31 come into communication with each other through the communication groove 21*e*. Therefore, the refrigerant supplied to the annular hole 27*a* is returned to the suction chamber 31 through the communication groove 21*e*. Thus, the annular hole 27*a*, which is the back pressure region, and the suction chamber 31, which is the suction pressure region, come into intermittent communication with each other through the communication groove 21*e* as the orbiting motion of the movable scroll 23 moves the projection 23*e*.

In the first embodiment, the recess 21*f* does not have to be formed in the shaft support 21. In this case, the refrigerant in the annular hole 27*a* is supplied to a gap between the plate 24 and the shaft support 21 through the communication hole 24*a*. The amount of refrigerant supplied from the annular hole 27*a* to the gap between the plate 24 and the shaft support 21 through the communication hole 24*a* is less than the amount of refrigerant supplied from the annular hole 27*a* to the recess 21*f* through the communication hole 24*a*. Therefore, compared to the first embodiment, the amount of refrigerant returned to the suction chamber 31 is small when the gap between the plate 24 and the shaft support 21 and the suction chamber 31 communicate with each other through the communication hole 24*a*. In this manner, the formation of the recess 21*f* in the shaft support 21 allows the amount of refrigerant returning from the back pressure region to the suction pressure region to be adjusted.

In the first embodiment, the communication hole 24*a* may be an elliptical hole, for example. The shape of the communication hole 24*a* is not particularly limited.

In the first embodiment, a plurality of communication holes 24*a* may be formed in the region Z of the range the projection 23*e* moves when the movable scroll 23 orbits. This example can increase the number of times the back pressure region and the suction pressure region intermittently communicate with each other through the communication hole 24*a* during each orbit of the movable scroll 23. As a result, the amount of refrigerant returning from the back pressure region to the suction pressure region can be adjusted.

In the first embodiment, only at least part of the communication hole 24*a* needs to be formed in the range the projection 23*e* moves during orbiting of the movable scroll 23.

In the first embodiment, a first oil passage that is in communication with the discharge chamber 131, which serves as the discharge pressure region, may be formed so that the shaft passage 20*c* is in communication with the discharge chamber 131 through the first oil passage.

In the first embodiment, the second oil passage 68, and the shaft passage 20*c* may be omitted.

The first embodiment is not limited to introducing the refrigerant through the first oil passage 65 to the back pressure region 62, 27*a*. In alternative embodiments, other passages may be operative to introduce the refrigerant to the back pressure region 62, 27*a*.

The invention claimed is:

1. A motor-driven compressor comprising:

a compression mechanism unit including a movable scroll and a fixed scroll operative to compress a refrigerant discharged from a suction pressure region, wherein the movable scroll and the fixed scroll defines a compression chamber having a volume that is decreased by an orbiting motion of the movable scroll;

a rotation shaft;

an electric motor that drives the movable scroll with the rotation shaft;

a housing that accommodates the compression mechanism unit and the electric motor;

an opposing member arranged in the housing and opposed to the movable scroll, wherein the opposing member is located at a side of the movable scroll opposite to the fixed scroll, the opposing member includes an opposing end face, which is opposed to the movable scroll, and the movable scroll includes a movable end face, which is opposed to the opposing member;

a back pressure region located at a side of the movable scroll proximate to the opposing member, wherein the back pressure region is configured so that a pressure of the refrigerant in the back pressure region is operative to apply a force to the movable scroll, and the force is operative to push the movable scroll against the fixed scroll; and a projection, formed in a gap between the movable scroll and the opposing member, arranged in the movable end face, wherein the projection separates the back pressure region and the suction pressure region from each other;

wherein the orbiting motion of the movable scroll moves the projection together with the movable scroll, the opposing member includes a communicating portion, and when the orbiting motion of the movable scroll moves the projection, the projection intermittently prevents the communicating portion from communicating between the back pressure region and the suction pressure region.

2. The motor-driven compressor according to claim 1, wherein the housing includes a motor compartment that accommodates the electric motor and forms the suction pressure region;

the back pressure region and a bearing accommodation chamber are formed between the movable scroll and the opposing member;

the bearing accommodation chamber accommodates a bearing that supports the rotation shaft proximal to the compression mechanism unit;

the back pressure region and the bearing accommodation chamber are disconnected by a barrier;

the rotation shaft includes a shaft passage;

the shaft passage includes an outlet that opens to the motor compartment;

the motor-driven compressor further includes a discharge pressure region, a first oil passage that communicates the compression chamber to the back pressure region, and a second oil passage that communicates the bearing accommodation chamber with the discharge pressure region; and the shaft passage is in communication with the first oil passage or the second oil passage.

3. A motor-driven compressor comprising:

a compression mechanism unit including a movable scroll and a fixed scroll operative to compress a refrigerant discharged from a suction pressure region, wherein the movable scroll and the fixed scroll defines a compression chamber having a volume that is decreased by an orbiting motion of the movable scroll;

a rotation shaft;

an electric motor that drives the movable scroll with the rotation shaft;

a housing that accommodates the compression mechanism unit and the electric motor;

an opposing member arranged in the housing and opposed to the movable scroll, wherein the opposing member is located at a side of the movable scroll opposite to the fixed scroll, the opposing member includes an opposing end face, which is opposed to the movable scroll, and the movable scroll includes a movable end face, which is opposed to the opposing member;

a back pressure region located at a side of the movable scroll proximate to the opposing member, wherein the back pressure region is configured so that a pressure of the refrigerant in the back pressure region is operative to apply a force to the movable scroll, and the force is operative to push the movable scroll against the fixed scroll; and a projection, formed in a gap between the movable scroll and the opposing member, arranged in the movable end face, wherein the projection separates the back pressure region and the suction pressure region from each other;

wherein the orbiting motion of the movable scroll moves the projection together with the movable scroll, the opposing member includes a communicating portion, and when the orbiting motion of the movable scroll moves the projection, the communicating portion intermittently communicates the back pressure region to the suction pressure region, wherein the back pressure region and the suction pressure region are configured to be out of communication with each other when the communicating portion is located at a radially inner side of the projection, and to be in communication with each other when at least part of the communicating portion is located at a radially outer side of the projection.

4. A motor-driven compressor comprising:

a compression mechanism unit including a movable scroll and a fixed scroll operative to compress a refrigerant discharged from a suction pressure region, wherein the movable scroll and the fixed scroll defines a compression chamber having a volume that is decreased by an orbiting motion of the movable scroll;

a rotation shaft;

an electric motor that drives the movable scroll with the rotation shaft;

a housing that accommodates the compression mechanism unit and the electric motor;

an opposing member arranged in the housing and opposed to the movable scroll, wherein the opposing member is located at a side of the movable scroll opposite to the fixed scroll, the opposing member includes an opposing end face, which is opposed to the movable scroll, and the movable scroll includes a movable end face, which is opposed to the opposing member;

a back pressure region located at a side of the movable scroll proximate to the opposing member, wherein the back pressure region is configured so that a pressure of the refrigerant in the back pressure region is operative to apply a force to the movable scroll, and the force is operative to push the movable scroll against the fixed scroll;

a projection, formed in a gap between the movable scroll and the opposing member, arranged in the movable end face, wherein the projection separates the back pressure region and the suction pressure region from each other;

a motor compartment that accommodates the electric motor in the housing, wherein the motor compartment forms the suction pressure region; and an accommodation compartment that accommodates the compression mechanism unit; and a shaft support arranged in the housing, wherein the shaft support defines the motor compartment and the accommodation compartment;

wherein the orbiting motion of the movable scroll moves the projection together with the movable scroll, the opposing member includes a communicating portion, and when the orbiting motion of die movable scroll moves the projection, the communicating portion intermittently communicates the back pressure region to the suction pressure region, wherein the opposing member includes a plate arranged between the compression mechanism unit and the shaft support to seal the back pressure region and the suction pressure region, and a communication hole serving as the communicating portion and formed in the plate.

5. The motor-driven compressor according to claim 4, wherein the shaft support includes a shaft supporting end face opposed to the plate;

and the shaft supporting end face includes a recess that opens to the communication hole.

* * * * *